US011365503B2

(12) United States Patent
Colin et al.

(10) Patent No.: US 11,365,503 B2
(45) Date of Patent: Jun. 21, 2022

(54) LAUNDRY WASHING MACHINE

(71) Applicant: Electrolux Appliances Aktiebolag, Stockholm (SE)

(72) Inventors: Igor Colin, Porcia (IT); Marcin Lorenc, Porcia (IT); Diana Moruzzi, Porcia (IT); Ashish Gupta, Porcia (IT); Rukesh Narayanan K R, Porcia (IT)

(73) Assignee: Electrolux Appliances Aktiebolag

( * ) Notice: Subject to any disclaimer, the term of this patent is extended or adjusted under 35 U.S.C. 154(b) by 194 days.

(21) Appl. No.: 16/797,761

(22) Filed: Feb. 21, 2020

(65) Prior Publication Data

US 2020/0270800 A1 Aug. 27, 2020

(30) Foreign Application Priority Data

Feb. 26, 2019 (EP) ..... 19159504

(51) Int. Cl.

| | |
|---|---|
| ***D06F 37/22*** | (2006.01) |
| *D06F 37/26* | (2006.01) |
| *D06F 37/24* | (2006.01) |

(52) U.S. Cl.

CPC ..... *D06F 37/22* (2013.01); *D06F 37/225* (2013.01); *D06F 37/24* (2013.01); *D06F 37/245* (2013.01); *D06F 37/265* (2013.01)

(58) Field of Classification Search

CPC ..... D06F 37/22; D06F 37/225; D06F 37/24; D06F 37/245; D06F 37/265

See application file for complete search history.

(56) References Cited

U.S. PATENT DOCUMENTS 5,850,749 A * 12/1998 Kim ..... D06F 37/225 68/23.2
5,857,361 A * 1/1999 Jang ..... D06F 37/225 68/23.2

(Continued)

FOREIGN PATENT DOCUMENTS

EP 0810317 A1 12/1997
EP 1862577 A2 12/2007

(Continued)

OTHER PUBLICATIONS

Extended European Search Report for European Application No. 19 159 504.0, dated Aug. 2, 2019, 7 pages.

(Continued)

*Primary Examiner* — Joseph L. Perrin
(74) *Attorney, Agent, or Firm* — RatnerPrestia

(57) ABSTRACT

A laundry washing machine having an outer casing, a washing tub, a rotatable drum and at least one balancing ring rigidly secured to the rotatable drum. The at least one balancing ring includes a substantially toroidal, annular housing that is rigidly secured to the drum, and has a tubular structure so as to delimit a closed annular inner cavity. A number of balancing masses are accommodated in movable manner inside the annular inner cavity, preferably together with a damping liquid. The annular housing has a substantially frustoconical outer wall segment that is inclined by an angle (β) lower than 90° with respect to the midplane (P) of the annular housing, and a peripheral supporting structure that juts out outwardly from the substantially frustoconical outer wall segment to stably abut against the body of the drum.

14 Claims, 4 Drawing Sheets

(56) References Cited

U.S. PATENT DOCUMENTS

| | | | | |
|---|---|---|---|---|
| 7,942,026 | B2 * | 5/2011 | Ryu | D06F 37/225 68/23.1 |
| 9,394,643 | B2 * | 7/2016 | Malheiros | D06F 37/245 |
| 2007/0283727 | A1 * | 12/2007 | Kim | D06F 37/225 68/3 R |
| 2008/0110212 | A1 | 5/2008 | Kim et al. | |
| 2011/0162442 | A1 * | 7/2011 | Ronlan | D06F 37/24 73/66 |
| 2013/0086953 | A1 * | 4/2013 | Choi | D06F 37/225 68/139 |
| 2014/0208805 | A1 * | 7/2014 | Jung | D06F 37/22 68/23.2 |
| 2015/0082837 | A1 * | 3/2015 | Malheiros | D06F 37/245 68/131 |
| 2015/0322614 | A1 * | 11/2015 | Borlin | F16F 7/1034 188/378 |
| 2015/0322615 | A1 * | 11/2015 | Borlin | D06F 37/225 68/140 |
| 2015/0345067 | A1 * | 12/2015 | Erickson | D06F 37/225 68/139 |
| 2018/0038034 | A1 * | 2/2018 | Kwak | D06F 37/225 |

FOREIGN PATENT DOCUMENTS

| | | | |
|---|---|---|---|
| EP | 2578738 | A1 | 4/2013 |
| KR | 20070115295 | A | 12/2007 |

OTHER PUBLICATIONS

Extended European Search Report for European Application No. 19 159 502.4, dated Aug. 2, 2019, 7 pages.

Non Final Office Action for U.S. Appl. No. 16/797,687, dated Sep. 30, 2021, 16 pages.

* cited by examiner

LAUNDRY WASHING MACHINE

This application claims priority to and the benefit of European Application No. EP 19159504.0, filed on Feb. 26, 2019, which is incorporated herein by reference.

FIELD OF THE INVENTION

The present invention relates to a laundry washing machine.

More in detail, the present invention relates to a front-loading home laundry washing machine, to which the following description specifically refers purely by way of example and without this implying any loss of generality.

BACKGROUND OF THE INVENTION

As is known, a front-loading home laundry washing machine generally comprises: a substantially parallelepiped-shaped, self-supporting boxlike outer casing structured for resting on the floor; a substantially horizontally-oriented and nearly cylindrical, cup-shaped washing tub which, in use, contains the washing liquid and is suspended in floating manner inside the casing, with the front mouth directly facing a laundry loading-unloading through opening formed in the front wall of the casing; a substantially cylindrical, cup-shaped rotatable drum which is structured for accommodating the laundry to be washed, and is fitted in axially rotatable manner inside the washing tub with the concavity facing the laundry loading-unloading opening, so as to be able to freely rotate inside the washing tub about its substantially horizontally-oriented, central axis locally coinciding with the longitudinal axis of the washing tub; an elastically-deformable bellows which watertight connects the front mouth of the washing tub to the laundry loading-unloading opening formed in the front wall of the casing; a porthole door which is hinged to the front wall of the casing to rotate to and from a closing position in which the door closes the laundry loading-unloading opening in the front wall of the casing for watertight sealing the washing tub; and an electrically-powered motor assembly which is structured for driving into rotation the rotatable drum about its longitudinal axis inside the washing tub.

To reduce vibrations of the drum during spin phases with unbalance loads, today's high end laundry washing machines are additionally provided with at least one and usually two ball balancing rings which are rigidly secured to the drum body perfectly coaxial to the drum rotation axis.

More specifically, each ball balancing ring is substantially circular in shape and is usually secured to the drum body, outside of the drum and adjacent to the front or rear rim of the drum cylindrical wall, coaxial to the drum rotation axis.

Each ball balancing ring moreover basically comprises: a rigid, hollow toroidal housing having inside a perfectly circular, closed annular inner cavity; and a number of heavy spherical masses accommodated in free movable manner inside the inner cavity of the toroidal housing together with a viscous liquid that damps out the movement of the spherical masses inside the inner cavity. The toroidal housing is secured to the drum body perfectly coaxial to the drum rotation axis, so that the annular inner cavity lies/extends on a plane perfectly perpendicular to the drum rotation axis.

During spin phases, the spherical masses tend to group together and to move altogether inside the inner cavity so as to balance the unbalanced load (laundry) momentarily placed inside the drum.

EP1862577 A2 discloses a front-loading laundry washing machine wherein the hollow toroidal housing of the ball balancing ring is divided into two discrete and complementary annular members that are made of plastic material and are fused together, and wherein the transversal/poloidal cross-section of the annular inner cavity is nearly rectangular in shaped.

More in detail, the first annular member has a nearly U-shaped cross-section with the two opposite and concentric, cylindrical lateral walls extending perpendicular to the midplane or equatorial plane of the toroidal housing, i.e. the plane perpendicular to the central axis of the torus and containing the geometric barycentres of all the transversal cross-sections of the torus. The second annular member, in turn, has a nearly plate-like annular structure and is welded in abutment against the inner and outer annular rims/edges of the first annular member, so as to fluid-tight close the circular groove delimited by said first annular member.

The first annular member therefore extends astride of the midplane of the toroidal housing, whereas the second annular member lies/extends on a plane parallel to and spaced apart from the same midplane.

In addition to the above, the first annular member is provided with a number of support appendages that protrude outwards from the cylindrical outer lateral wall nearly perpendicular to the same wall and are adapted to stably abut against the drum body for centring and providing stable support to the whole ball balancing ring.

The main drawback of this structure is that, during spin phases, the cylindrical outer lateral wall of the first annular member is subjected to centrifugal forces capable of bending outwards the toroidal sectors of the lateral wall between two consecutive support appendages, with all problems that this entails.

Experimental tests, in fact, revealed that, when drum rotation speed exceeds about 1000 rpm, the ball balancing rings become much more noisy than expected. The noise seems to be caused by the spherical masses not rolling any more on a perfectly cylindrical surface due to the deformed profile of the cylindrical outer lateral wall of the first annular member.

To minimize this problem, the thickness of the cylindrical outer lateral wall of the first annular member is usually highly oversized, with all problems that this entails in terms of overall dimensions, weight and production costs of the ball balancing ring.

SUMMARY OF THE INVENTION

Aim of the present invention is to realize a balancing ring capable of overcoming the drawback referred above.

In compliance with the above aims, according to the present invention there is provided a laundry washing machine having an outer casing and comprising, inside said outer casing: a washing tub adapted to contain the washing liquid; a rotatable drum which is fitted in axially rotatable manner inside the washing tub and is adapted to contain the laundry to be washed; and at least one balancing ring which is rigidly secured to the rotatable drum for reducing the vibrations of the drum;

said at least one balancing ring comprising: a substantially toroidal, annular housing which is rigidly secured to the drum and has a tubular structure so as to delimit a closed annular inner cavity; and a number of balancing masses accommodated in free movable manner inside said annular inner cavity; the annular housing having furthermore a peripheral supporting structure adapted to stably abut against the body of the drum;

the laundry washing machine being characterized in that said annular housing has a substantially frustoconical, outer wall segment which is inclined by an angle lower than 90° with respect to a midplane of the annular housing; and in that said peripheral supporting structure juts out outwardly from said substantially frustoconical, outer toroidal wall segment of the annular housing.

Preferably, though not necessarily, the laundry washing machine is furthermore characterized in that the axis around which the drum rotates is horizontal, or slightly inclined, with respect to the plane where the machine rests in its working position.

Preferably, though not necessarily, the laundry washing machine is furthermore characterized in that the opening angle of said substantially frustoconical, outer toroidal wall segment of the annular housing ranges between 60° and 130°.

Preferably, though not necessarily, the laundry washing machine is furthermore characterized in that the peripheral supporting structure of said annular housing includes an annular ridge or rib that protrudes outwardly from the annular housing preferably in a nearly radial direction, and is adapted to stably abut/rest against the body of the drum.

Preferably, though not necessarily, the laundry washing machine is furthermore characterized in that the peripheral supporting structure of said annular housing includes a plurality of support appendages that jut out outwardly from the annular housing, are angularly spaced about the central axis of the annular housing, and are adapted to stably abut/rest against the body of the drum.

Preferably, though not necessarily, the laundry washing machine is furthermore characterized in that said support appendages jut out from the said substantially frustoconical, outer wall segment of the annular housing in a direction substantially perpendicular to a central axis of said annular housing.

Preferably, though not necessarily, the laundry washing machine is furthermore characterized in that said support appendages are coplanar to one another.

Preferably, though not necessarily, the laundry washing machine is furthermore characterized in that said support appendages are regularly angularly spaced about the central axis of the annular housing.

Preferably, though not necessarily, the laundry washing machine is furthermore characterized in that the annular housing has a substantially polygonal-shaped, transversal cross-section, so as to delimit a closed annular inner cavity with a substantially polygonal-shaped cross-section.

Preferably, though not necessarily, the laundry washing machine is furthermore characterized in that the polygon defining/resembling the transversal cross-section of the annular housing has at least five sides, and/or each side of the polygon defining/resembling the transversal cross-section of the annular housing is non-perpendicular to the midplane of the annular housing.

Preferably, though not necessarily, the laundry washing machine is furthermore characterized in that the annular housing includes a first and a second annular hemishells, which are discrete and complementary to one another, are substantially coplanar and concentric to one another, and are joined to one another so as to form/delimit said annular inner cavity; said second/outer annular hemishell including the substantially frustoconical, outer toroidal wall segment of said annular housing.

Preferably, though not necessarily, the laundry washing machine is furthermore characterized in that said first and said second annular hemishells extend astride of the midplane of the annular housing.

Preferably, though not necessarily, the laundry washing machine is furthermore characterized in that the transversal cross-section of said second/outer annular hemishell has a substantially C-shaped, curved polygonal-chain profile with at least three straight line segments connected and inclined to one another.

Preferably, though not necessarily, the laundry washing machine is furthermore characterized in that said second/outer annular hemishell is joined to said first/inner annular hemishell along respective first and second annular rims/edges, and includes a first toroidal wall segment and a second toroidal wall segment nearly faced and non-parallel to one another, and a third toroidal wall segment connecting the first toroidal wall segment to the second toroidal wall segment; the first annular rim/edge edging the first toroidal wall segment of said second/outer annular hemishell; the second annular rim/edge edging the second toroidal wall segment of said second/outer annular hemishell; the third toroidal wall segment of said second/outer annular hemishell forming/defining the substantially frustoconical, outer toroidal wall segment of the annular housing.

Preferably, though not necessarily, the laundry washing machine is furthermore characterized in that the peripheral supporting structure of said annular housing is made in one piece with said second/outer annular hemishell.

Preferably, though not necessarily, the laundry washing machine is furthermore characterized in that the peripheral supporting structure includes a number of oblong-shaped, outwards-extending fixing protrusions that jut out from said second/outer annular hemishell in a nearly radial direction.

Preferably, though not necessarily, the laundry washing machine is furthermore characterized in that the transversal cross-section of said first/inner annular hemishell has a substantially C-shaped, curved polygonal-chain profile with at least three straight line segments connected and inclined to one another.

Preferably, though not necessarily, the laundry washing machine is furthermore characterized in that said first/inner annular hemishell is joined to said second/outer annular hemishell along respective first and second annular rims/edges, and includes a first toroidal wall segment and a second toroidal wall segment nearly faced and non-parallel to one another, and a third toroidal wall segment connecting the first toroidal wall segment to the second toroidal wall segment; the first annular rim/edge edging the first toroidal wall segment of said first/inner annular hemishell; the second annular rim/edge edging the second toroidal wall segment of said first/inner annular hemishell.

Preferably, though not necessarily, the laundry washing machine is furthermore characterized in that said first/inner annular hemishell and said second/outer annular hemishell are stably joined/coupled to one another along corresponding first and second mating annular rims/edges.

Preferably, though not necessarily, the laundry washing machine is furthermore characterized in that said first and second mating annular rims/edges are arranged on opposite sides of the midplane of the annular housing.

Preferably, though not necessarily, the laundry washing machine is furthermore characterized in that said first/inner and said second/outer annular hemishells are made of plastic material and are reciprocally welded along said first and second mating annular rims/edges.

Preferably, though not necessarily, the laundry washing machine is furthermore characterized in that the balancing ring includes, inside the annular inner cavity, a damping liquid that damps out the movement of the balancing masses inside the same annular inner cavity.

Preferably, though not necessarily, the laundry washing machine is furthermore characterized in that the balancing ring is rigidly secured directly to the cylindrical wall of the drum.

Preferably, though not necessarily, the laundry washing machine is furthermore characterized in that the balancing ring is located inside the drum.

Preferably, though not necessarily, the laundry washing machine is furthermore characterized in that the balancing masses are spherical in shape.

BRIEF DESCRIPTION OF THE DRAWINGS

A non-limiting embodiment of the present invention will now be described, by way of example, with reference to the accompanying drawings, in which.

DETAILED DESCRIPTION OF EXEMPLARY EMBODIMENTS

Figure 1:
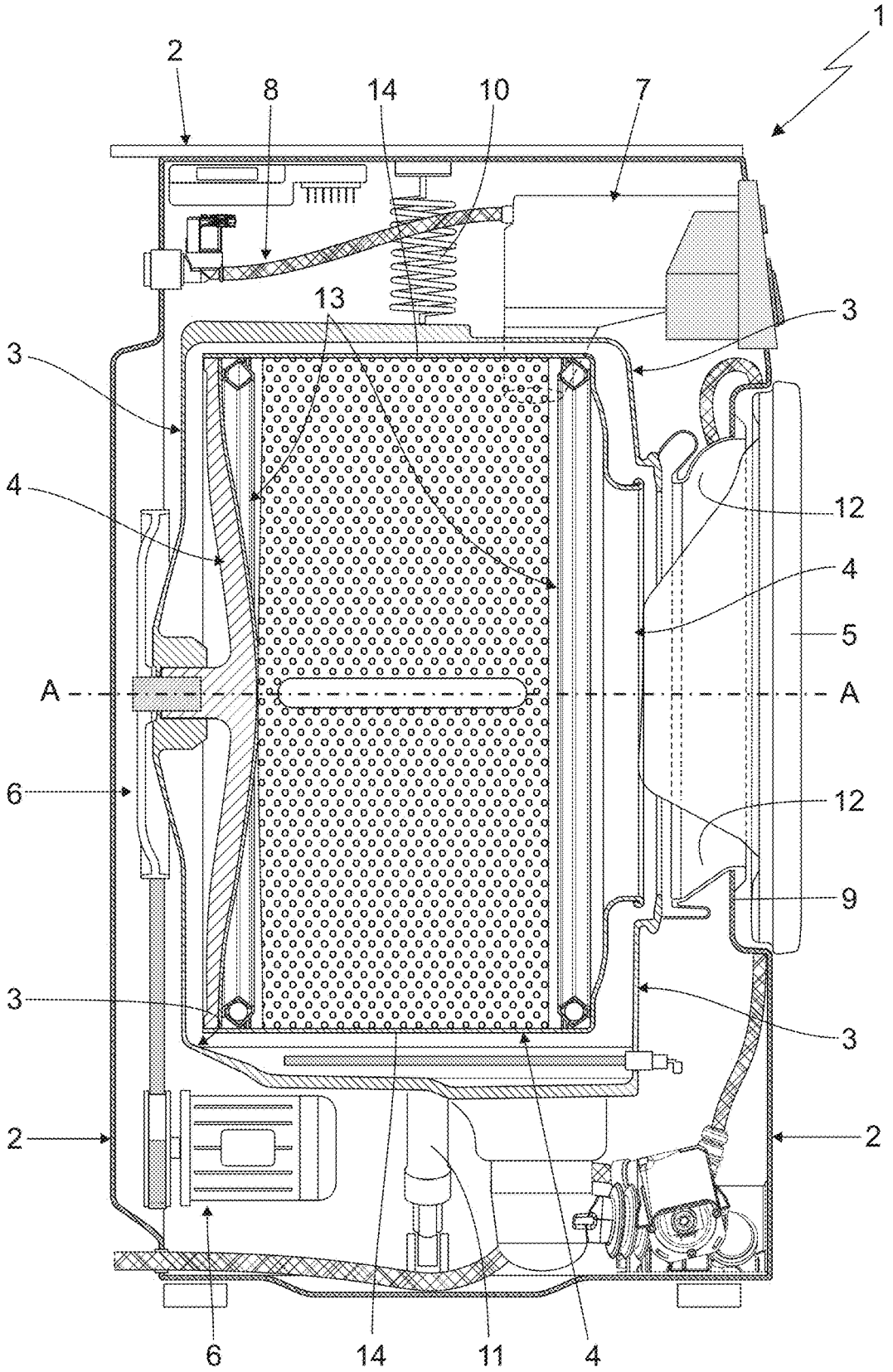
FIG. 1 is a side view of a laundry washing machine realized in accordance with the teachings of the present invention, sectioned along the midplane of the washing machine and with parts removed for clarity.
Figure 2:
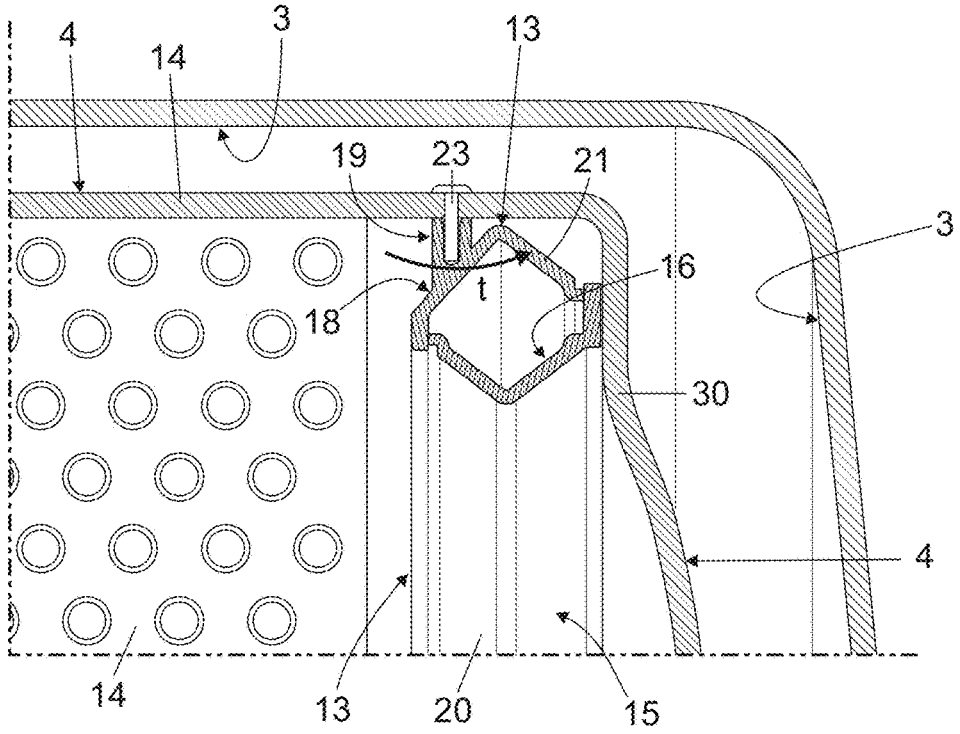
FIG. 2 is an enlarged view of part of the laundry washing machine shown in FIG. 1, with parts removed for clarity.

With reference to FIGS. 1 and 2, reference number 1 denotes as a whole a laundry washing machine 1 preferably suitable for domestic use.

The laundry washing machine 1 basically comprises: a preferably substantially parallelepiped-shaped, self-supporting boxlike outer casing 2 structured for stably resting on the floor; a preferably substantially cylindrical, washing tub 3 which, in use, contains the washing liquid and is arranged inside the casing 2 with its mouth directly facing a laundry loading-unloading opening formed on outer casing 2; a substantially cylindrical, hollow rotatable drum 4 which is structured for accommodating the laundry to be washed, and is fitted in axially rotatable manner inside the washing tub 3 so as to be able to freely rotate about its longitudinal/central axis A inside the washing tub 3; a door 5 which is hinged to the outer casing 2 so as to be manually movable to and from a closing position (see FIG. 1) in which the door 5 closes the laundry loading-unloading opening on the boxlike casing 2 for watertight sealing the washing tub 3; and an electrically-powered motor assembly 6 which is structured for driving into rotation the rotatable drum 4 about its longitudinal axis A inside the washing tub 3.

Moreover the laundry washing machine 1 comprises, inside the outer casing 2, a detergent dispenser 7 and a fresh-water supply circuit 8.

The detergent dispenser 7 is preferably located inside the outer casing 2 above the washing tub 3 and preferably, though not necessarily, immediately underneath an upper worktop or top wall of casing 2, and is structured for selectively feeding into the washing tub 3, preferably according to a washing cycle manually-selected by the user, a given amount of detergent, softener and/or other washing agent suitably mixed with water.

The fresh-water supply circuit 8, in turn, is directly connected/connectable to the water mains, and is structured for selectively channelling, preferably according to the washing cycle manually-selected by the user, a flow of water from the water mains to the detergent dispenser 7 and/or directly to the washing tub 3.

In the example shown, in particular, the washing tub 3 is preferably substantially cup-shaped, is preferably arranged substantially horizontally inside the outer casing 2, and is preferably provided with a nearly circular front mouth that directly faces a complementary-shaped, laundry loading-unloading opening formed on a front wall 9 of casing 2.

With reference to FIG. 1, the door 5, in turn, is preferably hinged to the front wall 9 so as to be manually movable, preferably about a nearly vertically-oriented rotation axis, to and from a closing position in which the door 5 closes the laundry loading-unloading opening on front wall 9 for watertight sealing the washing tub 3.

Furthermore, the washing tub 3 is preferably suspended in floating manner inside the boxlike casing 2 via a suspension system that preferably comprises at least one, and preferably a couple of coil springs 10 connecting the upper portion of washing tub 3 to the top of casing 2, and preferably at least one and more conveniently a couple of vibration dampers 11 connecting the bottom portion of washing tub 3 to the bottom of casing 2.

Preferably the laundry washing machine 1 moreover comprises an elastically-deformable tubular bellows 12 that watertight connects the front mouth of washing tub 3 to the laundry loading-unloading opening formed on the front wall 9 of boxlike casing 2.

The rotatable drum 4, on the other hand, is preferably substantially cup-shaped and is fitted in axially rotatable manner inside the washing tub 3 with its concavity facing the front mouth of washing tub 3. Preferably the rotatable drum 4 is furthermore arranged inside washing tub 3 with the drum rotation axis A locally substantially coaxial to the longitudinal axis of washing tub 3, and with its nearly circular front mouth directly aligned and faced to the front mouth of washing tub 3, so as to receive the laundry to be washed through the laundry loading-unloading opening present on front wall 9. In other words, the drum rotation axis A is preferably substantially horizontal.

Figure 3:
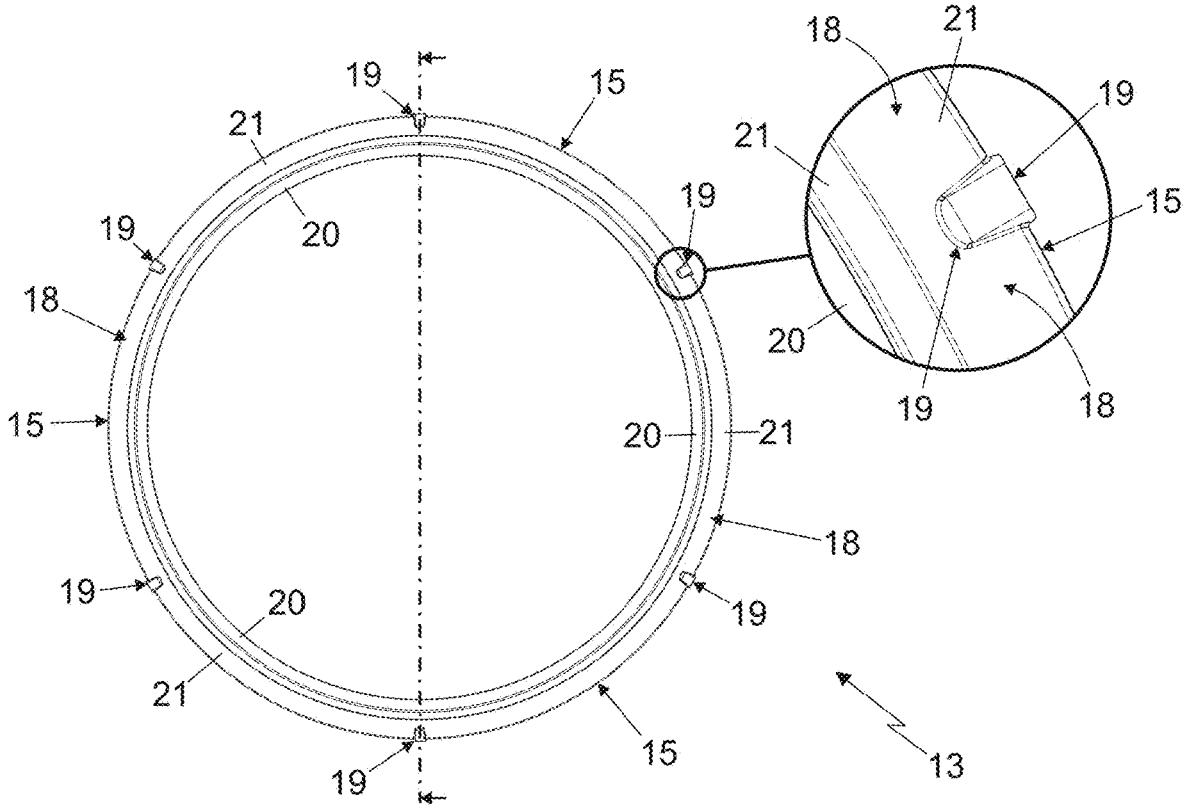
FIG. 3 is a front view of one of the balancing rings of the laundry washing machine shown in FIGS. 1 and 2.

With reference to FIGS. 1, 2 and 3, laundry washing machine 1 additionally comprises at least one balancing ring 13 which is discrete from rotatable drum 4, is rigidly secured to the rotatable drum 4 substantially coaxial to the drum rotation axis A, and is adapted to minimize/reduce the vibrations produced by drum 4 when rotating at high speed about the rotation axis A while accommodating an unbalance load of laundry.

More in detail, the/each balancing ring 13 is substantially circular in shaped, and is preferably accommodated inside of drum 4 coaxial to drum rotation axis A. Preferably the/each balancing ring 13 is furthermore rigidly secured directly to the cylindrical wall 14 of drum 4.

In the example shown, in particular, the washing machine 1 is preferably provided with two balancing rings 13 which are rigidly secured to the body of rotatable drum 4, preferably inside the drum 4 and preferably adjacent to the front and rear rims of the cylindrical wall 14 of drum 4.

With reference to FIGS. 2-5, the/each balancing ring 13 basically comprises: a substantially toroidal, rigid annular housing 15 which is adapted to be rigidly secured to the body of drum 4, or rather to the cylindrical wall 14 of drum 4, so that its central axis B substantially coincides with the drum rotation axis A, and has a tubular structure so as to delimit, inside itself, a closed annular cavity 16 which is circular in shape, is coaxial to central axis B and preferably has a substantially uniform cross-section; a number of heavy balancing masses 17 which are accommodated in free movable manner inside the inner cavity 16 of annular housing 15; and a damping liquid (not shown in the figures) that fills up, preferably completely, the inner cavity 16 of annular housing 15 for damping out the movement of the balancing masses 17 inside the inner cavity 16.

More in detail, the balancing masses 17 are preferably spherical in shape so as to roll on the inner surface of the hollow annular housing 15, and are preferably made of metal material. Preferably, the balancing masses 17 are moreover dimensioned so as to take up more than 50% of the cross-section of the annular inner cavity 16.

The damping liquid, in turn, is preferably a silicon-based liquid and/or preferably has a viscosity higher than 200 cSt (centistokes).

It is to be understood that, in toroidal geometry, a transversal cross-section of the torus is a section of the torus according to a cutting plane which extends radially from the central axis of the torus and is, at same time, perpendicular to any plane perpendicular to the central axis of the torus, whereas the midplane or equatorial plane of the torus is the plane perpendicular to the central axis of the torus and containing the geometric barycentres of all the transversal cross-sections of the torus.

Figure 5:
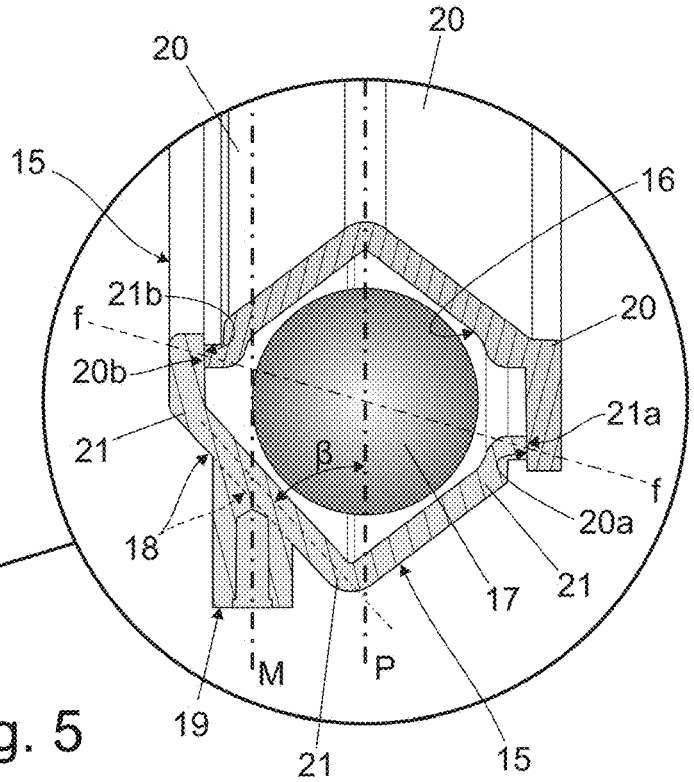
FIG. 5 is an enlarged side view of the balancing ring shown in FIGS. 3 and 4, sectioned along the midplane of the washing machine and with parts removed for clarity.

With reference to FIGS. 2, 3, and 5, the annular housing 15 is furthermore provided with a peripheral supporting structure which is adapted to stably abut against the body of drum 4, or rather to the cylindrical wall 14 of drum 4, preferably for centring and/or providing stable support to the balancing ring 13 onto the rotatable drum 4.

Differently from known ball balancing rings, however the annular housing 15 has an outer toroidal wall segment 18 which is located nearly opposite to the central axis B, is substantially frustoconical in shape and is inclined by an angle β lower than 90° with respect to the midplane P of annular housing 15, i.e. the plane perpendicular to central axis B and containing the geometric barycentres of almost all the transversal cross-sections of annular housing 15; and the peripheral supporting structure of annular housing 15 juts out outwardly from said substantially frustoconical, outer toroidal wall segment 18.

More in detail, the opening angle of said nearly frustoconical, outer toroidal wall segment 18 of annular housing 15 preferably ranges between 60° and 130°.

The peripheral supporting structure of annular housing 15 moreover preferably includes a plurality of preferably substantially oblong-shaped, support appendages 19 that jut out outwardly from the annular housing 15 preferably in a nearly radial direction, are angularly spaced about the central axis B, and are adapted to stably abut/rest against the body of drum 4, or rather to the cylindrical wall 14 of drum 4, preferably with their distal end. Preferably the support appendages 19 are furthermore substantially regularly angularly spaced around the central axis B.

In addition to the above, the transversal cross-section of annular housing 15 is preferably substantially polygonal in shape, and the polygon defining/resembling the transversal cross-section of annular housing 15 preferably has at least five sides. Preferably each side of the polygon is furthermore non-perpendicular to the midplane P of the annular housing 15.

In the example shown, in particular, the transversal cross-section of annular housing 15 preferably has approximately the shape of an irregular hexagon. Preferably the opening angle of the toroidal wall segment 18 is moreover equal to about 95°.

The/each support appendage 19, furthermore, preferably extend outwards of annular housing 15 in a nearly radial direction substantially parallel to the midplane P, i.e. substantially perpendicular to the central axis B of annular housing 15. Preferably the support appendages 19 additionally extend coplanar to one another.

In other words, the support appendages 19 preferably extend outwards from the substantially frustoconical, toroidal wall segment 18 of annular housing 15 in a nearly radial direction while remaining astride of a common lying plane M which is substantially parallel to and preferably also spaced from the midplane P of annular housing 15.

With reference to FIGS. 2-6, preferably the annular housing 15 is moreover divided into, or at least includes, two discrete and complementary annular hemishells 20 and 21 that are preferably substantially coplanar and concentric to one another, and are watertight joined/coupled to one another so as to form/delimit the annular inner cavity 16. In turn, the peripheral supporting structure of annular housing 15, or rather the support appendages 19, is preferably located on the outer annular hemishell 11.

In other words, the outer annular hemishell 21 preferably includes the nearly frustoconical, outer toroidal wall segment 18 of annular housing 15.

More specifically, both annular hemishells 20 and 21 preferably extend astride of the midplane P of annular housing 15 (i.e. the plane perpendicular to central axis B and containing the geometric barycentres of almost all the transversal cross-sections of annular housing 15), and the annular hemishell 21 surrounds the annular hemishell 20.

The support appendages 19, on the other hand, preferably protrude outwardly from the outer annular hemishell 21 in a nearly radial direction.

Figure 6:
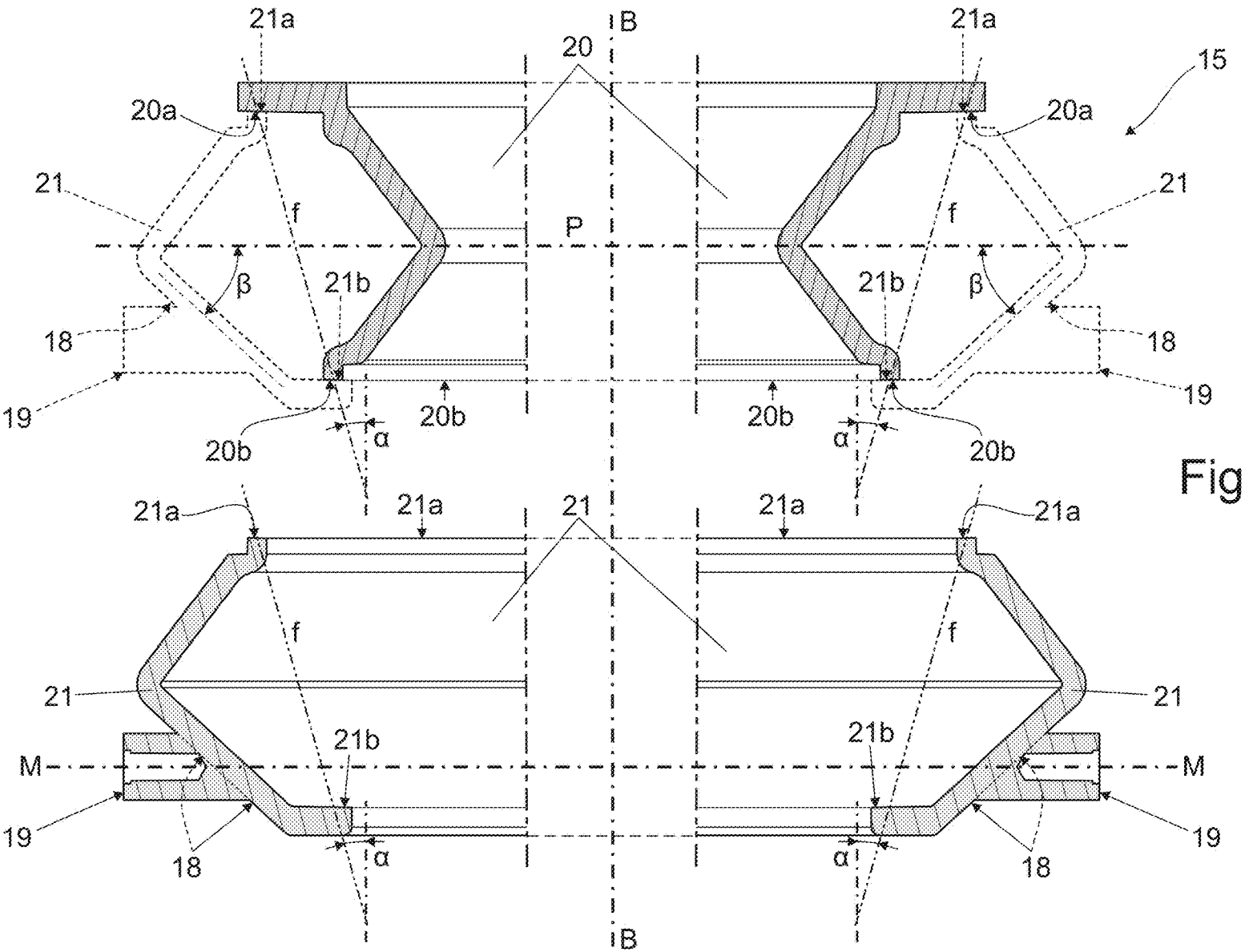
FIG. 6 is an exploded view of the toroidal hollow annular housing of the balancing ring shown in the preceding figures, sectioned along the midplane of the washing machine.

With reference to FIGS. 2, 5 and 6, in the examples shown, in particular, the transversal cross-section of both annular hemishells 20 and 21 preferably has a substantially C-shaped, curved polygonal-chain profile, so as to form/delimit an annular inner cavity 16 having a substantially polygonal-shaped cross-section.

In other words, the transversal cross-section of both annular hemishells 20 and 21 basically consists of a series of straight line segments connected and inclined to one another so as to resemble a C.

Preferably the straight line segments of said substantially C-shaped, curved polygonal-chain profile have lengths different to one another.

Preferably the transversal cross-section of annular housing 15 and annular inner cavity 16, therefore, has the shape of an irregular polygon.

With reference to FIG. 6, in the example shown, in particular, the curved polygonal-chain profile of the transversal cross-section of inner annular hemishell 20 preferably includes three or more straight line segments connected and inclined to one another.

Similarly the curved polygonal-chain profile of the transversal cross-section of outer annular hemishell 21 preferably includes three or more straight line segments connected and inclined to one another.

In other words, the substantially C-shaped, curved polygonal-chain profile of the transversal cross-section of annular hemishell 20 and/or 21 preferably includes three or more straight line segments connected and inclined to one another, so as to form/delimit an annular inner cavity 16 with a nearly hexagonal-shaped, transversal cross-section.

In addition to the above, with particular reference to FIGS. 5 and 6, the inner and outer annular hemishells 20 and 21 are stably joined/coupled to one another along corresponding mating annular rims/edges 20*a*, 21*a* and 20*b*, 21*b* that are preferably located on opposite sides of the midplane P of annular housing 15.

In other words, the inner annular hemishell 20 preferably has an approximately C-shaped transversal cross-section with the concavity facing the outer annular hemishell 21, i.e. opposite to central axis B, and it is joined to the outer annular hemishell 21 along respective first 20*a* and second 20*b* annular rims/edges, that are coaxial to central axis C and are preferably also located on opposite sides of the midplane P.

The outer annular hemishell 21, in turn, preferably has an approximately C-shaped transversal cross-section with the concavity facing the central axis B and the inner annular hemishell 20, and it is joined to the inner annular hemishell 20 along respective first 21*a* and second 21*b* annular rims/edges, that are coaxial to central axis C and are preferably also located on opposite sides of the midplane P.

Preferably the outer annular hemishell 21, therefore, encircles the inner annular hemishell 20 so that its two annular rims/edges 21*a* and 21*b* area aligned and stably coupled/joined each to a respective and facing annular rim/edge 20*a*, 20*b* of annular hemishell 20.

Preferably the annular hemishells 20 and 21 are furthermore shaped so that the two annular rims/edges 20*a* and 20*b* of annular hemishell 20 and the two annular rims/edges 21*a* and 21*b* of annular hemishell 21 are located/extend/lie on a same/common frustoconical surface which is coaxial to the central axis B of annular housing 15 and has an opening angle lower than 150°.

More in detail, the opening angle of said frustoconical surface preferably ranges between 20° and 70°. In other words, the generatrix f of the frustoconical surface makes an angle $\alpha$ with respect to central axis B preferably ranging between 10° and 35°.

In the example shown, in particular, the annular rims/edges 20*a*, 20*b*, 21*a* and 21*b* of the annular hemishells 20 and 21 are located/extend/lie on a frustoconical surface whose generatrix f is preferably inclined with respect to central axis B by an angle $\alpha$ roughly equal to 15°.

In other words, the opening angle of the frustoconical surface on which the annular rims/edges 20*a*, 20*b*, 21*a* and 21*b* of inner and outer annular hemishells 20 and 21 lie is preferably equal to roughly 30°.

In addition to the above, the annular hemishells 20 and 21 are preferably made of plastic material and are stably fused/joined to one another preferably via vibration welding.

Therefore, the two annular rims/edges 20*a* and 20*b* of inner annular hemishell 20 are stably joined/fused to the corresponding mating annular rims/edges 21*a* and 21*b* of outer annular hemishell 21 preferably by vibration welding.

According to an alternative embodiment, however, the two annular rims/edges 20*a* and 20*b* of inner annular hemishell 20 may be stably joined to the mating annular rims/edges 21*a* and 21*b* of outer annular hemishell 21 by gluing.

Figure 4:
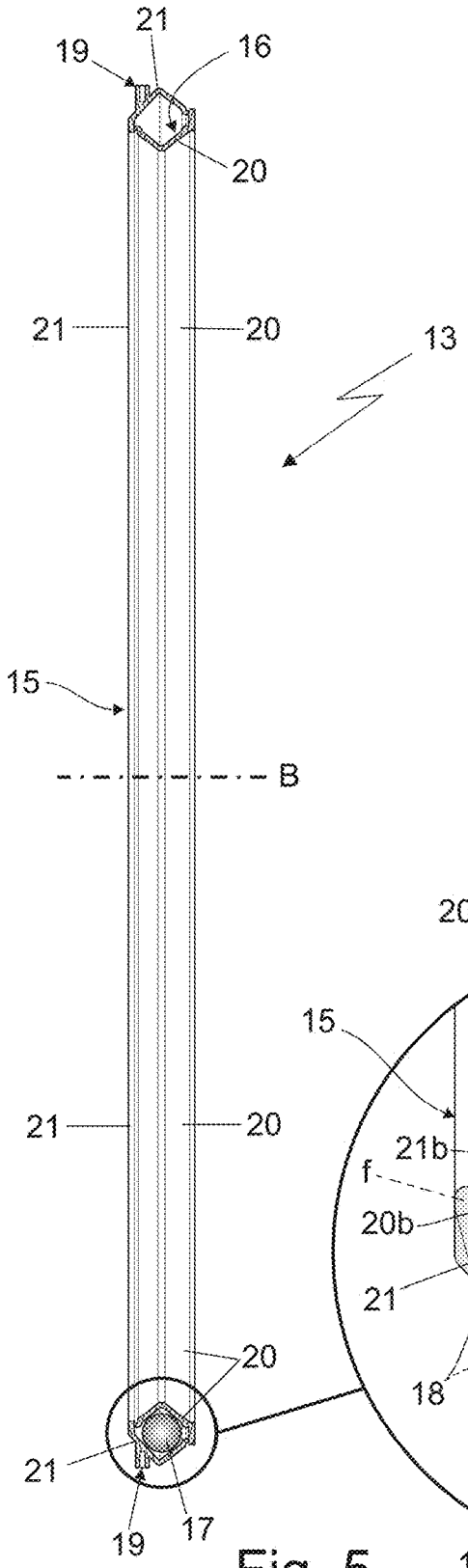
FIG. 4 is an enlarged perspective view of a segment of the balancing ring shown in FIGS. 1, 2 and 3.
Figure 4:
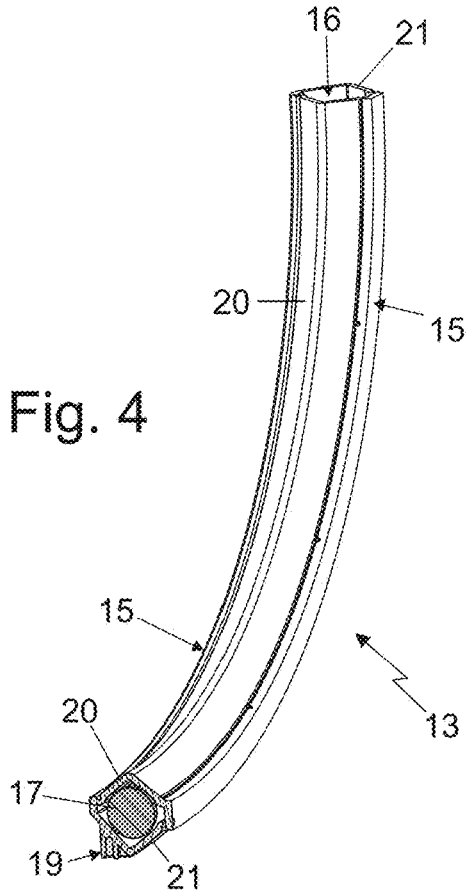

With reference to FIGS. 4, 6 and 7, in the example shown, in particular, the inner annular hemishell 20 is preferably provided with a first toroidal wall segment and a second toroidal wall segment nearly faced and non-parallel to one another, and a third toroidal wall segment connecting the first toroidal wall segment to the second toroidal wall segment.

The first annular rim/edge 20*a* of inner annular hemishell 20 edges the first toroidal wall segment of annular hemishell 20, whereas the second annular rim/edge 20*b* of inner annular hemishell 20 edges the second toroidal wall segment of annular hemishell 20.

Similarly, the outer annular hemishell 21 is preferably provided with a first toroidal wall segment and a second toroidal wall segment nearly faced and non-parallel to one another, and a third toroidal wall segment connecting the first toroidal wall segment to the second toroidal wall segment.

The first annular rim/edge 21*a* of outer annular hemishell 21 edges the first toroidal wall segment of annular hemishell 21, whereas the second annular rim/edge 21*b* of outer annular hemishell 21 edges the second toroidal wall segment of annular hemishell 21.

Moreover, the first toroidal wall segment of outer annular hemishell 21 is preferably faced to the second toroidal wall segment of inner annular hemishell 20. The second toroidal wall segment of outer annular hemishell 21 is preferably faced to the first toroidal wall segment of inner annular hemishell 20. The third toroidal wall segment of outer annular hemishell 21 is preferably faced to the third toroidal wall segment of inner annular hemishell 20.

In addition to the above, the third toroidal wall segment of outer annular hemishell 21 preferably forms/defines the substantially frustoconical, outer toroidal wall segment 18 of annular housing 15.

With reference to FIGS. 3 and 6, in turn, the peripheral supporting structure of annular housing 15 is preferably made in one piece with the outer annular hemishell 21. More in detail, each support appendage 19 of annular housing 15 preferably consists in an oblong-shaped, outwards-extending fixing protrusion which is made in one piece with the outer annular hemishell 21 and juts out from the third toroidal wall segment of annular hemishell 21, opposite to the inner annular hemishell 20 and preferably in a nearly radial direction. Preferably the distal end of said fixing protrusion is furthermore structured to stably rest against the body of drum 4, or rather against the cylindrical wall 14 of drum 4.

In the example shown, in particular, the peripheral supporting structure of annular housing 15 preferably includes six fixing protrusions 19 which are preferably regularly angularly spaced around central axis B, and are additionally coplanar to one another. Moreover each fixing protrusion 19 is preferably substantially cylindrical or frustoconical in shape and the distal end of the same fixing protrusion is preferably substantially flat and optionally also perpendicular to the longitudinal axis of the same fixing protrusion.

With particular reference to FIGS. 2, 5 and 6, preferably each support appendage 19 of annular housing 15, or rather each fixing protrusion of outer annular hemishell 21, is finally adapted to be engaged by a preferably radially-extending, fixing screw 23 that extend in pass-through manner through the body of drum 4, or rather through the cylindrical wall 14 of drum 4.

More in detail, each fixing protrusion 19 of annular hemishell 21 is preferably provided with a radially-oriented, blind central hole adapted to be engaged by the threaded stem of the fixing screw 23.

Operation of laundry washing machine 1 is almost identical to that of any other laundry washing machine and therefore does not require further explanations.

As regards the balancing rings 13, during spin phases, the balancing masses 17 tend to group together and to move inside the annular inner cavity 16 of annular housing 15 so as to balance the unbalanced load, i.e. the laundry, momentarily placed inside the drum 4.

The advantages resulting from the particular structure of balancing ring 13 are large in number.

First of all, being substantially frustoconical in shape, the outer toroidal wall segment 18 of annular housing 15, or rather the third toroidal wall segment of outer annular hemishell 21, is intrinsically much more rigid than a traditional cylindrical-shaped toroidal wall segment. Therefore the minimum thickness of the wall requested to safely support the centrifugal forces is significantly reduced, with all advantages that this entails.

The hollow annular housing 15, in fact, is significantly lighter than the hollow annular housing of today's ball balancing rings.

Additionally the polygonal-shaped transversal cross-section of annular housing 15 allows to significantly increase the overall stiffness of the annular housing 15, thus bringing almost close to zero the in-use deformations even when drum rotation speed rises far beyond 1000 rpm.

As a consequence, the laundry washing machine 1 is less noisy that today's laundry washing machines with traditional balancing rings.

Finally, with reference to FIG. 2, since the common lying plane M of the support appendages 19 of annular housing 15, or rather of the fixing protrusions of outer annular hemishell 21, is preferably slightly offset/spaced from the lying plane on which the barycentres of the balancing masses 17 move during spin phases, in use the support appendages 19 of annular housing 15, or rather the fixing protrusions of outer annular hemishell 21, are subjected to transversal forces t in the radial/transversal plane.

If the outer annular hemishell 21 rests in abutment against the cylindrical wall 14 of drum 4 and the inner annular hemishell 20 rests in abutment against a front wall 30 of drum 4, these transversal forces t can press the two annular hemishells 20 and 21 one against the other, thus significantly reducing the mechanical stresses on the welding lines/areas of annular housing 15.

Clearly changes and modifications may be made to laundry washing machine 1 and to balancing ring 13 without, however, departing from the scope of the present invention.

For example, in a less sophisticated embodiment the balancing ring 13 may lack the damping liquid.

Moreover, the series of angularly staggered outwards-extending support appendages 19 of the peripheral supporting structure of annular housing 15, may be replaced by a single annular rib or ridge that protrudes outwardly from the outer toroidal wall segment 18 of annular housing 15, or rather from the third toroidal wall segment of outer annular hemishell 21, and is adapted to stably abut/rest against the body of the drum 4. Preferably this annular rib or ridge furthermore extends outwards in a nearly radial direction so as to lie on a reference plane which is parallel and preferably also slightly offset/spaced from the midplane P of annular housing 15, i.e. perpendicular to the central axis B of annular housing 15.

According to an alternative embodiment, moreover the balancing ring or rings 13 may be firmly secured to the body of drum 4, outside of drum 4.

Furthermore, the front balancing ring 13 may be located/recessed into a specific annular seat formed in the front wall 30 of drum 4, obviously coaxial to drum longitudinal/rotation axis A.

The invention claimed is:

1. A laundry washing machine comprising:

an outer casing;

a washing tub inside the outer casing and configured to contain a washing liquid;

a drum fitted in an axially rotatable manner inside the washing tub and configured to contain laundry to be washed; and at least one balancing ring rigidly secured to the drum and configured to reduce vibrations generated during rotation of the drum, the at least one balancing ring comprising:

a toroidal annular housing surrounding a central axis (B) and rigidly secured to the drum and having a peripheral supporting structure configured to stably abut against a body of the drum, the toroidal annular housing comprising a first annular hemishell and a second annular hemishell, the first annular hemishell and the second annular hemishell being discrete and complementary to one another, coplanar and concentric to one another, and that are joined to one another so as to form a tubular structure defining a closed annular inner cavity, and a number of balancing masses accommodated in free movable manner inside the annular inner cavity, wherein the second annular hemishell has a frustoconical outer toroidal wall segment that is inclined relative to the center axis (B) at an angle of between 30° and 65°, wherein the peripheral supporting structure juts out outwardly from the frustoconical outer toroidal wall segment of the annular housing, and wherein the second annular hemishell comprises a first straight line segment and a second straight line segment integrally formed with the first straight line segment to form a vertex, with the first straight line segment and the second straight line segment extending in a radial direction from the vertex towards the center axis, and wherein the number of balancing masses are at least partially located between the first straight line segment and the second straight line segment with respect to a direction parallel to the center axis.

2. The laundry washing machine according to claim 1, wherein the peripheral supporting structure of the annular housing includes an annular ridge or rib that protrudes outwardly from the annular housing, and is configured to stably abut the body of the drum.

3. The laundry washing machine according to claim 2, wherein the annular ridge or rib protrudes outwardly from the annular housing in the radial direction.

4. The laundry washing machine according to claim 1, wherein the peripheral supporting structure of the annular housing includes a plurality of support appendages that jut out outwardly from the annular housing, are angularly spaced, in a plane parallel to the plane perpendicular to the central axis (B), about the central axis (B) of the annular housing, and are configured to stably abut the body of the drum.

5. The laundry washing machine according to claim 4, wherein the support appendages jut out from the frustoconical outer wall segment of the annular housing in a direction perpendicular to a central axis (B) of the annular housing.

6. The laundry washing machine according to claim 5, wherein the support appendages are coplanar to one another.

7. The laundry washing machine according to claim 4, wherein the support appendages are regularly angularly spaced, in a plane parallel to the plane perpendicular to the central axis (B), about the central axis (B) of the annular housing.

8. The laundry washing machine according to claim 1, wherein the annular housing has a polygonal-shaped transversal cross-section, so that the annular inner cavity has a polygonal-shaped cross-section.

9. The laundry washing machine according to claim 8, wherein the polygonal-shaped cross-section of the annular housing has at least five sides, and each of the at least five sides is non-perpendicular a midplane (P) of the annular housing.

10. The laundry washing machine according to claim 1, wherein the first annular hemishell and the second annular hemishell each extend astride of a midplane (P) of the annular housing.

11. The laundry washing machine according to claim 1, wherein a transversal cross-section of the second annular hemishell has a C-shaped, curved polygonal-chain profile with at least three straight line segments connected and inclined to one another.

12. The laundry washing machine according to claim 11, wherein:

the second annular hemishell is joined to the first annular hemishell along respective first and second annular rims, and includes a first toroidal wall segment and a second toroidal wall segment facing and non-parallel to one another, and a third toroidal wall segment connecting the first toroidal wall segment to the second toroidal wall segment;

the first annular rim is at an edge of the first toroidal wall segment of the second annular hemishell;

the second annular rim is at an edge of the second toroidal wall segment of the second annular hemishell;

and the third toroidal wall segment of the second annular hemishell forms the frustoconical outer toroidal wall segment of the annular housing.

13. The laundry washing machine according to claim 11, wherein the peripheral supporting structure of the annular housing is made in one piece with the second annular hemishell.

14. The laundry washing machine according to claim 13, wherein the peripheral supporting structure includes a number of oblong-shaped, outwards-extending fixing protrusions that jut out from the second annular hemishell in the radial direction.

* * * * *